US006203142B1

(12) United States Patent
Inui et al.

(10) Patent No.: US 6,203,142 B1
(45) **Date of Patent: *Mar. 20, 2001**

(54) LIQUID JET RECORDING METHOD AND APPARATUS AND RECORDING HEAD THEREFOR

(75) Inventors: Toshiharu Inui; Kazuhiro Nakajima, both of Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 07/968,537

(22) Filed: Oct. 29, 1992

(30) Foreign Application Priority Data

Oct. 29, 1991 (JP) ..... 3-283220

(51) Int. Cl.[7] ..... B41J 2/05
(52) U.S. Cl. ..... 347/56; 347/61
(58) Field of Search ..... 346/1.1, 140 R, 346/75; 347/56, 88, 61

(56) References Cited

U.S. PATENT DOCUMENTS

| | | | | |
|---|---|---|---|---|
| 4,313,684 | * | 2/1982 | Tazaki et al. | 347/140 R |
| 4,338,611 | * | 7/1982 | Eida et al. | 347/75 |
| 4,345,262 | * | 8/1982 | Shirato et al. | 347/140 R |
| 4,410,899 | * | 10/1983 | Haruta | 347/56 |
| 4,638,337 | | 1/1987 | Torpey et al. | 346/140 R |
| 4,723,129 | | 2/1988 | Endo et al. | 346/1.1 |
| 4,779,099 | * | 10/1988 | Lewis | 347/88 X |
| 4,897,674 | * | 1/1990 | Hirasawa | 346/140 R |
| 5,172,134 | * | 12/1992 | Kishida et al. | 347/56 X |
| 5,218,376 | * | 6/1993 | Asai | 347/61 |
| 5,270,730 | * | 12/1993 | Yaegashi et al. | 346/1.1 |
| 5,307,093 | * | 4/1994 | Suzuki | 347/99 X |

FOREIGN PATENT DOCUMENTS

| | | |
|---|---|---|
| 54161935 | 12/1979 | (JP) . |
| 55100169 | 7/1980 | (JP) . |
| 61197246 | 9/1986 | (JP) . |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A liquid jet recording method using thermal energy to eject liquid from a liquid passage through an ejection outlet, the liquid passage being provided with a heat generating resistor, wherein the following conditions are satisfied:

$S1 \geqq S2/3$, and $S2 \geqq S3/3$ where S1 is an area of the heat generating resistor, and S2 is a projected area, onto a surface having the heat generating resistor, of the liquid passage between the ejection outlet and the heat generating resistor; wherein a bubble created by the heat generating resistor communicates with ambience when the liquid is ejected.

8 Claims, 14 Drawing Sheets

LIQUID JET RECORDING METHOD AND APPARATUS AND RECORDING HEAD THEREFOR

FIELD OF THE INVENTION AND RELATED ART

The present invention relates to an ink jet recording method and apparatus and a recording head therefor in which liquid droplets are ejected using thermal energy onto a sheet of paper, resin sheet or cloth or another recording material.

In an ink jet recording method, the recording medium (ink) which is in the form of a liquid material or a heat-soluble solid material is deposited on the recording material using thermal energy. The recording method allows high speed recording (and provides relatively high record quality and the low noise). In addition, the method is relatively easily applicable to color image recording on a plain sheet of paper or cloth or the like. A further advantage is that the size of the apparatus is small.

The ink jet recording apparatus using this method comprises a recording head which has ejection outlets for ejecting the ink in the form of droplets, ink passages communicating with the ejection outlets and energy generating means for applying ejection energy to the ink in the liquid passage. U.S. Pat. No. 4,723,129 discloses a method in which the energy generating means is in the form of an electrothermal transducer, and the thermal energy produced by the electric pulse application is applied to the ink so as to eject the ink.

In the recording methods disclosed in the above U.S. patent, the ink, having absorbed the thermal energy, is subjected to a state change which causes a quick volume change by film boiling of the liquid. By the development and contraction of the bubble, the ink is ejected through the ejection outlet at an end of the recording head. The ejected droplets of the ink are deposited on the recording medium to form an image. According to this recording method, the ejection outlets may be arranged with high density in a recording head, and therefore, high speed, high resolution and high quality image can be recorded. The recording apparatuses using this method can be used as copying machines, printers, facsimile machines and other information outputting means.

Japanese Laid-Open Patent Application No. 161935/1979 discloses that ink in an ink chamber is turned to gas by a cylindrical heat generating element, and the gas is ejected through an ink ejection outlet together with ink droplets. According to this method, the gas and fine droplets are splashed with the result of low quality image. In addition, the ink is further gasified by the splash with the result of production of mist of the ink, which further contaminates the background of the record or the inside of the recording apparatus.

Japanese Laid-Open Patent Application No. 197246/1986 discloses a modified ink jet recording method or thermal transfer recording method, in which a single ink ejection is effected. Since it is difficult to completely contact the heat generating element to the recording material, the thermal efficiency tends to decrease as compared with the ink jet recording method using the recording head having the conventional ejection outlets. Therefore, it is not suitable for high speed recording.

On the other hand, U.S. Pat. No. 4,638,337 discloses as prior art, in which a bubble communicates with the ambient air. However, the communication between the bubble and the ambience occurs adjacent to the heat generating element, not adjacent to the ejection outlet. For this reason, it easily introduces the air into the neighborhood of the heat generating element with the result of unstable ink ejection, as properly described in the U.S. Patent.

In order to solve the above problems of the ink jet recording system, U.S. Ser. No. 692,935 has proposed that the bubble produced by the film boiling is caused to communicate with the ambience adjacent to the ejection outlet (communication ejection system).

With this communication ejection system, the gas constituting the bubble does not eject with the ink droplet so that the production of the splash or mist is reduced, and therefore, the contamination of the recording material and inside the apparatus can be prevented.

As a fundamental of the communication ejection system, the ink downstream of the bubble formation position is all ejected out in principle. Therefore, the amount of ejected ink can be determined on the basis of the structure of the recording head such as a distance from the ejection outlet to the bubble formation position. As a result, in the communication ejection system, the ejection amount can be stabilized without against influence of the ink temperature or the like.

Although the communication of the bubble to the ambience is improved to provide stabilized ink ejection, the detailed investigations have revealed that the communicating action varies slightly. The cause may include some unstable factor in the relative relations among the created bubble from the heat generating resistor ruling the development of the bubble, movement of the ink adjacent the ejection outlet, ejection of the ink through the ejection outlet and the communication between the ambience and the bubble.

In usual recording heads in which the thermal energy is instantaneously applied to a small area to produce film boiling, the size of the heat generating resistor is not more than 30,000 $\mu m^2$ at the maximum, and usually it is less than 5000 $\mu m^2$. In the communication ejection system, the liquid between the heat generating resistor to the ejection outlet is all ejected with substantial certainty. For this reason, the practical size of the heat generating resistor is not more than 3000 $\mu m^2$. The inventors have particularly noted the area of the heat generating resistor in the communication ejection system.

SUMMARY OF THE INVENTION

Accordingly, it is a principal object of the present invention to provide an ink jet recording method and apparatus and a recording head therefor in which the ink droplet formation is further stabilized, and further improved images can be formed with improved overall efficiency, in the communication ejection system in which the bubble created communicates with the ambience at the time of droplet ejection.

According to an aspect of the present invention, there is provided a liquid jet recording method using thermal energy to eject liquid from a liquid passage through an ejection outlet, said liquid passage being provided with a heat generating resistor, wherein the following conditions are satisfied:

$S1 \geqq S2/3$, and $S2 \geqq S3/3$ where S1 is an area of the heat generating resistor, and S2 is a projected area, onto a surface having the heat generating resistor, of the liquid passage between the ejection outlet and the heat generating resistor; wherein a bubble created by the heat generating resistor communicates with ambience when the liquid is ejected.

According to another aspect of the present invention, there is provided a recording apparatus comprising: a liquid ejection outlet; a liquid passage in communication with the ejection outlet; a electrothermal transducer having a heat generating resistor for supplying thermal energy to the liquid in the passage to eject the ink through the ejection outlet by creation of the bubble in the liquid in the liquid passage; signal supplying means for supplying electric signals to the resistor; wherein the following conditions are satisfied:

$S1 \geqq S2/3$, and $S2 \geqq S3/3$ where S1 is an area of the heat generating resistor, and S2 is a projected area, onto a surface having the heat generating resistor, of the liquid passage between the ejection outlet and the heat generating resistor; wherein a bubble created by the heat generating resistor communicates with ambience when the liquid is ejected.

According to a further aspect of the present invention, there is provided a recording head comprising: a liquid ejection outlet; a liquid passage in communication with the ejection outlet; an electrothermal transducer having a heat generating resistor for supplying thermal energy to the liquid in the passage to eject the ink through the ejection outlet by creation of the bubble in the liquid in the liquid passage; wherein the following conditions are satisfied:

$S1 \geqq S2/3$, and $S2 \geqq S3/3$ where S1 is an area of the heat generating resistor, and S2 is a projected area, onto a surface having the heat generating resistor, of the liquid passage between the ejection outlet and the heat generating resistor; wherein a bubble created by the heat generating resistor communicates with ambience when the liquid is ejected.

If the above conditions are satisfied, quick and efficient bubble expansion and communication ejection, are accomplished, and therefore, the ejected droplet volumes and the ejection speeds are made more uniform. Therefore, the image quality is improved.

The present invention is suited for use in one or more of the following conditions:

(1) When the ink is ejected, the ink is not disconnected by the bubble.

(2) When the bubble is brought into communication with the ambience, the internal pressure of the bubble is not higher than the ambient pressure.

(3) When the bubble is brought into communication with the ambience, the acceleration of the front end of the bubble toward the ejection outlet is not positive.

(4) When the bubble is brought into communication with the ambience, $l_a/l_b \geqq 1$ is satisfied, where $l_a$ is a distance between an ejection outlet side edge of the flat heater and a front end of the bubble, and $l_b$ is a distance between such an edge of the heater as is opposite from the outlet side edge of the rear end of the bubble.

BRIEF DESCRIPTION OF THE DRAWINGS

In FIGS. 9A–E, a top sectional view and side sectional view are shown at the left side and the right side with the same time scale.

DESCRIPTION OF THE PREFERRED EMBODIMENTS

The preferred embodiments of the present invention will be described in detail. The communication ejection will be described later.

Figure 1:
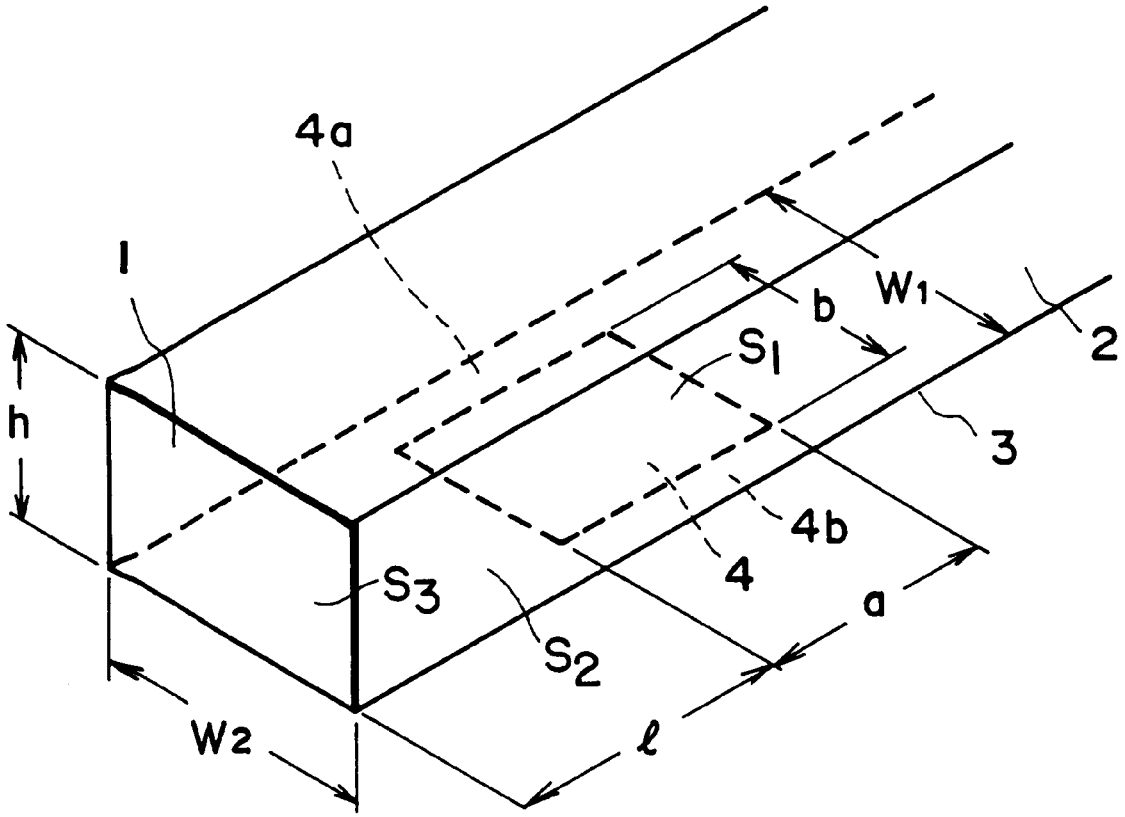
FIG. 1 is a perspective view of an ink jet recording head for illustrating the present invention.

Referring to FIG. 1, there is shown a recording head using the recording liquid ejecting method according to an embodiment of the present invention, wherein an ejection outlet 1 and a liquid passage 2 are shown in enlarged scales. A base plate 3 defining a part of the liquid passage 2 is provided with a heater 4 and lines 4*a* and 4*b* or the like connected to the heater 4. The heater 4 has a length a and a width b. The heater area (the area of a heat generating resistor) S1 is expressed as $S1=a \times b$. The liquid passage 2 has a width W1, and the distance between the heater 4 and the ejection outlet 1 is l. Therefore, a projected area S2 of the liquid passage between the ejection outlet 1 and the heater 4 projected on the base plate 3, is lW1. The ejection outlet 1 has a width W2 and a height h. Therefore, the cross-sectional area of the ejection outlet 1 is S3=hW2. In the figure W1 =W2. The liquid jet recording head according to this embodiment is such that S1, S2 and S3 satisfy $S1 \geqq S2/3$ and $S2 \geqq S3/3$.

Using such a recording head, the instantaneous expansion of the bubble is possible, and the communication between the bubble and the ambience can be established at stable timing.

The investigations and experiments by the inventors have revealed that it is important to satisfy $S1>S2/3$ and $S2 \geqq S3/3$, since then the timing of the communication between the bubble and the ambience is stabilized to overcome the above-described unstable, factors affecting the bubble creation such as the heater affecting expansion of the bubble, ink movement adjacent the ejection outlet, ejection of the ink through the ejection outlet and the communication between the bubble and the ambience.

If $S1 \geqq S2/3$ is not satisfied, the bubble itself produced by the heater is not stable, and therefore, the stabilized bubble ejection is not possible with efficient communication between the bubble and the ambience through the ejection outlet. In other words, the bubble does not communicate with the ambience with sufficient energy, the ink remaining adjacent the ejection outlet after the communication clogs the ejection outlet and with the result of an air bubble being introduced into the liquid passage. Particularly in the case of continuous recording (continuous ejections), it is not possible to eject the stabilized liquid droplets.

If S2≧S3/3 is not satisfied, the efficient communication between the bubble and the ambience through the ejection outlet is satisfactory. However, the bubble is brought into communication with the ambience through the ejection outlet in some cases, prior to the development of the bubble to a sufficient height size. This may result in formation of relatively small plural droplets which are ejected out. Although the amount is small, some splash tends to occur.

Examples of the present invention will be described.

EXAMPLES 1–8

Various recording heads having the structures indicated in Tables 1 and 2, were manufactured. Not all of the recording heads produced are shown, but the disclosed ones will be sufficient to understand the present invention. In Tables 1 and 2, the units of the length is μm and the unit of the area is $\mu m^2$.

Figure 10:
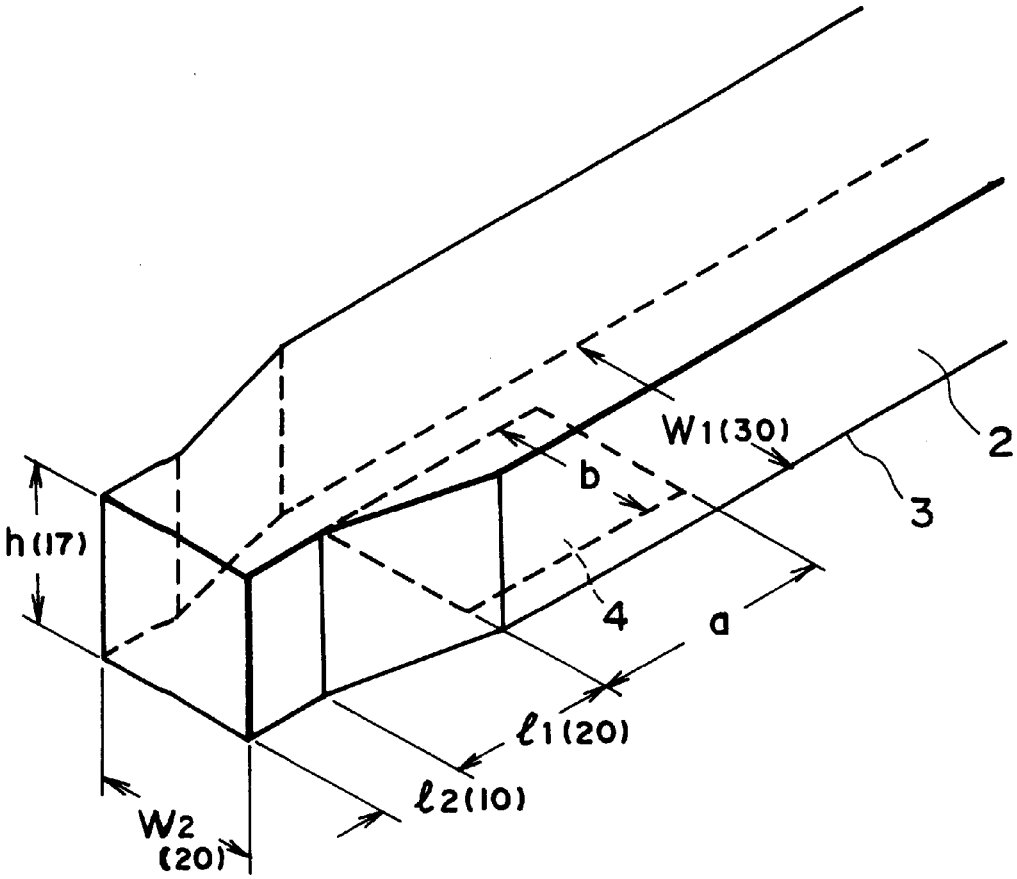
FIG. 10 illustrates another embodiment of the present invention.
Figure 11:
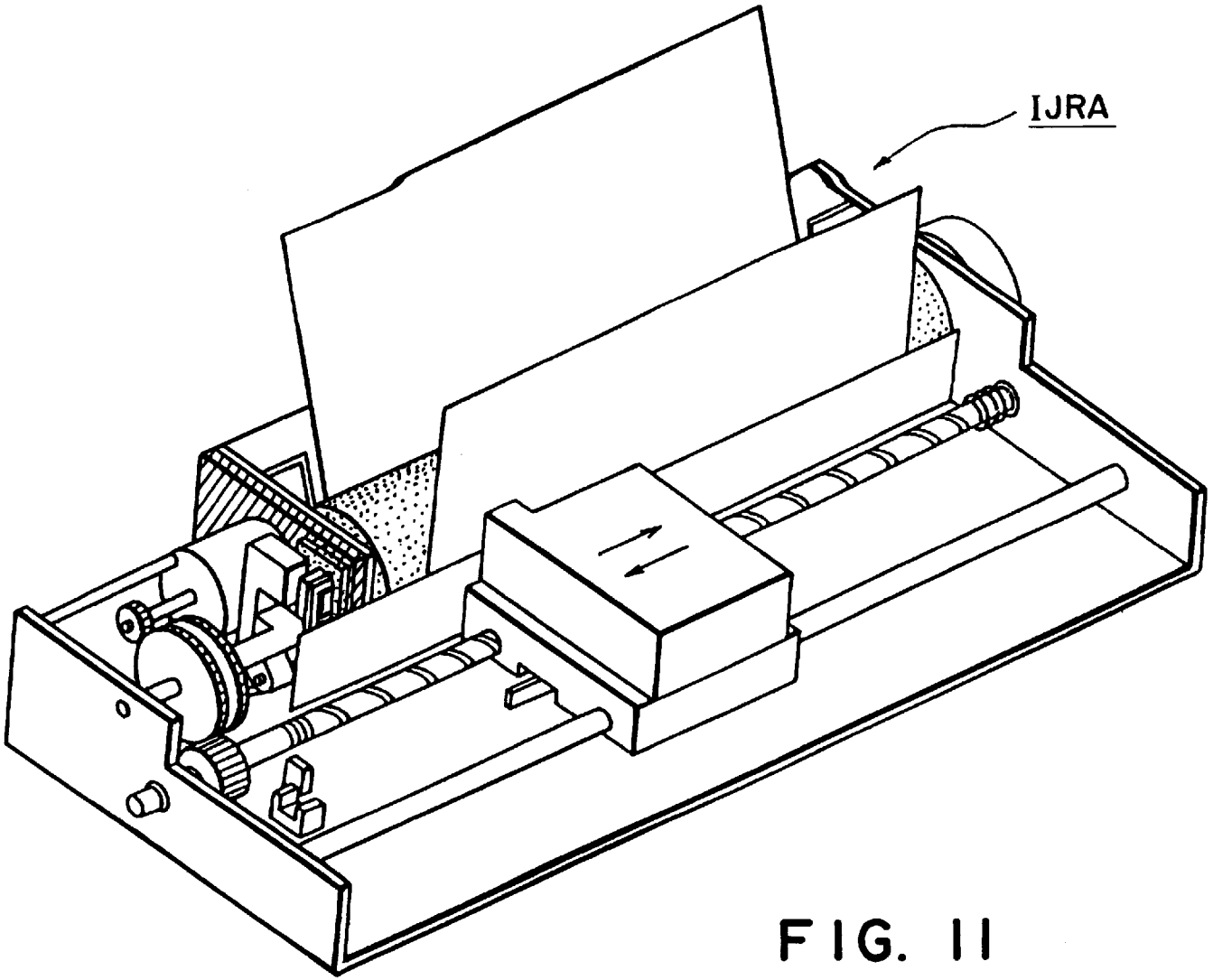
FIG. 11 shows a recording head according to an embodiment of the present invention.

In Examples 1–4 and 6–8, the configuration of the recording head is as shown in FIG. 1. The recording head in Example 5 is as shown in FIG. 10, in which the ejection outlet portion is reduced. With these 8 recording heads, the formation of the bubble was all satisfactory, and the image qualities were stabilized even during the continuous ejecting operations. From the standpoint of areas S1, S2 and S3, these examples all satisfy S1≧S2/3 and S2≧S3/3. Examples 1, 2 and 4–7 further satisfies S1≧S2/3 and S2≧S3/2. The recording head is in the form of a multi-nozzle type recording head, as shown in FIG. 3 which will be described hereinafter. In all of the examples, one head had 48 nozzles arranged at the density of 400 nozzles per inch.

The ink used comprised:

| | |
|---|---|
| C.I. Hood Black 2 | 3.0%byweight |
| Diethylene glycol | 15.0%byweight |
| N-methyl-2-pyrrolidone | 5.0%byweight |
| Ion exchanger water | 77.0%byweight |

They are uniformly mixed and solved, and then, filtered through a Teflon filter having a pore size of 0.45 μm. The ink had the viscosity of 2.0 cps (20° C.). The heater actuation condition for the recording head was such that the heating time is always 2.5 μsec, and the applied voltage is 10.4 V, 13.3 V, 15.4 V, 9.2 V, 9.5 V, 9.2 V, 13.8 V and 9.2 V in Examples 1–8, respectively. The frequency was 2 kHz.

A transparent ink which is the same as the above-described ink but not containing the C.I. Hood Black, was supplied, and the ink in the nozzle was observed by a microscope while the ink was illuminated from the top plate side by a pulse illumination source. The gradual expansion of the bubble and the communication with the ambience, were observed. With respect to Examples 1, 2, 4, 5, 7 and 8, hardly any ink remained adjacent to the ejection outlet, after the communication of the bubble with the ambience. However, in the case of Examples 3 and 8, a slight amount of ink remained adjacent to the ejection outlet. The ejection of the ink was further observed, and it has been found that the size of the main droplet was slightly smaller in Example 4, and the ejection speeds of the ink droplets in Examples 3 and 8, were smaller than in the other Examples.

Then, 48 heaters 4 were supplied with image signals so as to provide checker patterns provided by respective pixels. In Examples 1–5, desired checker patterns were produced on the recording material with sufficient printing uniformity. When this image was observed in an enlarged scale, it has been confirmed that the ink does not scatter and does not result in the background fog.

TABLE 1

| Ex- | Heater | | Liquid passage | | Ejection outlet | | | | | |
|---|---|---|---|---|---|---|---|---|---|---|
| amples | a | b | W1 | l | W2 | h | S1 | S2 | S3 | Shape |
| 1 | 26 | 22 | 30 | 20 | 30 | 18 | 572 | 600 | 540 | FIG. 1 |
| 2 | 30 | 30 | 40 | 30 | 40 | 30 | 900 | 1200 | 1200 | FIG. 1 |
| 3 | 40 | 32 | 40 | 12 | 40 | 35 | 1280 | 480 | 1400 | FIG. 1 |
| 4 | 18 | 22 | 30 | 26 | 30 | 22 | 396 | 780 | 660 | FIG. 1 |
| 5 | 24 | 20 | 30 | 30 | 20 | 17 | 480 | 700 | 340 | FIG. 10 |
| 6 | 18 | 22 | 30 | 35 | 30 | 22 | 396 | 1050 | 660 | FIG. 1 |
| 7 | 20 | 32 | 42 | 40 | 42 | 32 | 640 | 1680 | 1344 | FIG. 1 |
| 8 | 18 | 22 | 30 | 15 | 30 | 35 | 396 | 450 | 1050 | FIG. 1 |

Comparison Examples 1–4

Four recording heads having the structure indicated in Table 2, were manufactured. Similarly to Examples 1–5, 48 nozzles are arranged at the density of 400 nozzle per inch.

The recording heads of Examples 1 and 3 do not satisfy S1≧S2/3, and the recording heads of Comparison Examples 2 and 4 do not satisfy S2≧S3/3.

The recording heads were supplied with the same ink as in Examples 1–8. The heater actuating conditions are such that the heating period was 2.5 μsec and the applied voltages were 11.8 V, 8.9 V, 8.9 V and 8.9 V for the respective heads. They are driven at 2 kHz.

With Comparison Examples 1 and 3, the communication ejections were not possible continuously. When the observation was carried out, it was confirmed that there are bubbles adjacent the heaters.

With Comparison Examples 2 and 4, the continuous ejections were possible, and therefore, the checker patterns were produced in the same manner as Example 1. The image quality is not adequate because of the scattering of the ink and the resulting contamination. When the observation is carried out using the pulse illumination source, it has been confirmed that there is no main droplet, but there are small ink droplets ejected toward the recording material.

As will be understood from the Examples and Comparison Examples, the present invention notes the projection area, onto the surface of the substrate, of the heat generating resistor between the ejection outlet and the heat generating resistor. The present invention is particularly suitable when used with the communication ejection system in which the bubble communicates with the ambience upon the liquid ejection.

TABLE 2

| Comp. Ex- | Heater | | Liquid passage | | Ejection outlet | | | | | |
|---|---|---|---|---|---|---|---|---|---|---|
| amples | a | b | W1 | l | W2 | h | S1 | S2 | S3 | Shape |
| 1 | 16 | 25 | 40 | 32 | 40 | 27 | 400 | 1280 | 1080 | FIG. 1 |
| 2 | 20 | 20 | 28 | 8 | 28 | 25 | 400 | 224 | 700 | FIG. 1 |
| 3 | 20 | 20 | 30 | 50 | 30 | 30 | 400 | 1500 | 900 | FIG. 1 |
| 4 | 20 | 20 | 30 | 20 | 30 | 70 | 400 | 600 | 2100 | FIG. 1 |

Figure 2A:
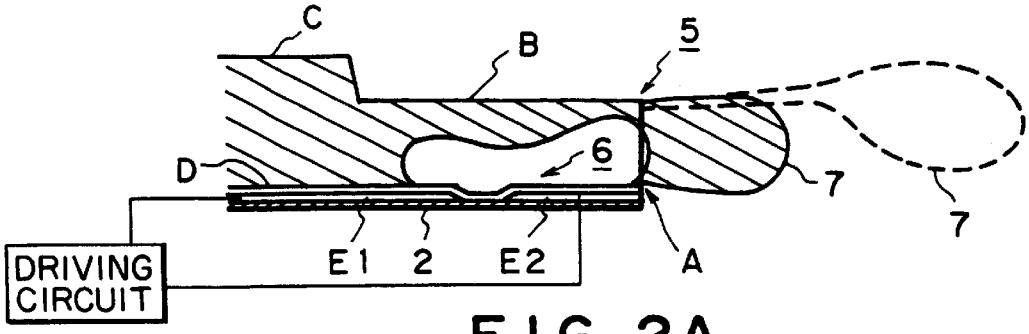
FIGS. 2A–C illustrate communication of a bubble with ambience.
Figure 2B:
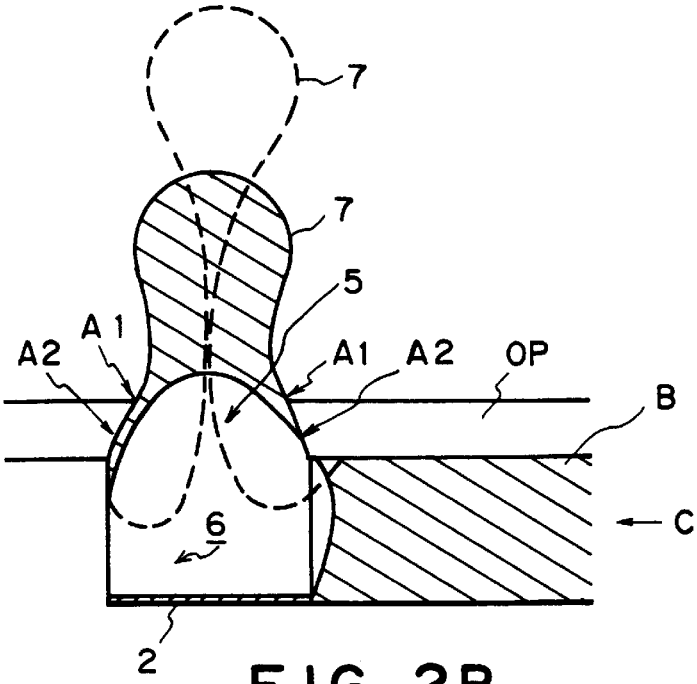
Figure 2C:
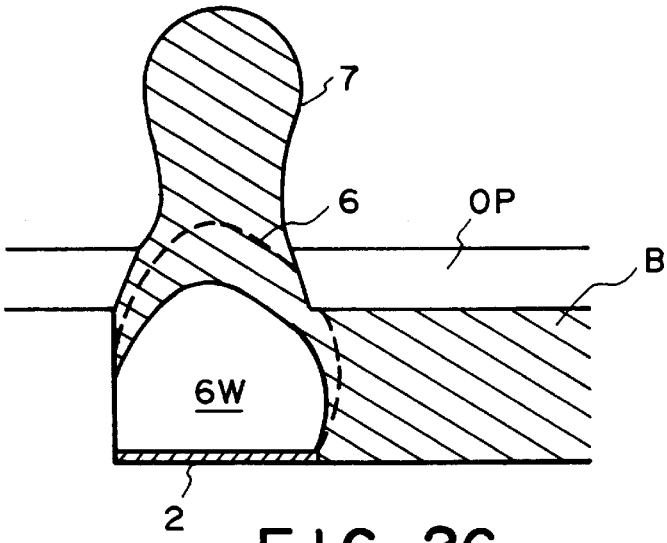

FIGS. 2A and 2B shows typical examples of liquid passages using the present invention. However, the present invention is not limited to these structures, as will be understood from the descriptions which will be made hereinafter.

In FIG. 2A, a heat generating resistor layer 2 is provided on a base plate (not shown), and a plurality of ejection outlets 5 are provided at an edge of the base plate. Selecting electrodes E1 and a common electrode E2 have known structures. Designated by reference characters D and C are a protection layer and a common liquid chamber, respectively.

In response to electric signals in the form of pulse signals in accordance with the recording signals supplied by the electrodes E1 and E2, the temperature of the heat generating portion between the electrodes E1 and E2 instantaneously rises to cause film boiling (not less than 300° C.), by which a bubble 6 is produced. In the embodiments of the present invention, the bubble 6 communicates with the ambience at its edge A adjacent the heat generating resistor layer 2 to produce a stabilized liquid droplet (broken line 7). Since the bubble communicates with the ambience (atmospheric air) adjacent the edge of the ejection outlet opening 5, the droplet of the ink can be created without splashing of the liquid and without the production of the mist. The thus produced droplet of liquid is ejected at and deposited on the recording material.

The recording principle is such that the liquid passage B is not completely blocked by the bubble 6 during the growth thereof. So, the ink refilling after the ejection is effected in good order. The accumulated heat by the high temperature (not less than 300° C.) is ejected into the ambience, and therefore, the frequency of the response is increased.

In FIG. 2B, the common liquid chamber C is not shown. The liquid passage B is bent, as contrasted to the structure shown in FIG. 2A, and the heat generating resistor 2 is provided on the surface of the base plate at the bent portion. The ejection outlet has a cross-section decreasing in the direction of ejection and face a heat generating resistor 2. The ejection outlets are formed in an orifice plate OP. The above described conditions A–D are particularly suitable in this structure.

Similarly to the structure of FIG. 2A, the film boiling (not less than 300° C.) is caused, by which the bubble 6 develops to displace the ink in the thickness of the orifice plate OP. The bubble 6 communicates with the ambience in a region between A1 which is an outside edge of the ejection outlet opening 5 and A2 which is adjacent to the ejection outlet opening. With this state of communication, a stabilized liquid droplet as shown by the broken line 7 can be ejected along the center of the ejection outlet without the splashing of liquid and without the production of the mist. The growth of bubble does not block the liquid passage. More particularly, when the bubble communicates with the ambience, the bubble does not completely block the passage. Rather, the liquid which is going to constitute the droplet is partly connected wit the liquid in the liquid passage. This increases the speed of the refilling of the liquid in the passage.

The description will be made as to the preferable conditions which may be incorporated individually or in combination in the structures shown in FIG. 2A or 2B to provide significantly better liquid droplet formation.

The first condition is that the bubble communicates with the ambience under the condition that the internal pressure of the bubble is lower than the ambient pressure. The communication under such a condition is preferable since then the unstable liquid adjacent the ejection outlet is prevented from scattering, although such liquid is scattered when the condition is not satisfied. In addition, it is advantageous in that the force, if not large, is applied to the unstable liquid in the backward direction, by which the liquid ejection is further stabilized, and the unnecessary liquid splashing can be suppressed.

The second condition is that the bubble communicates with the ambience under the condition that the first order differential of a movement speed of the front edge (the edge adjacent to the ejection outlet) of the bubble is negative.

The third condition is that the bubble communicates with the ambience under the condition of $l_a/l_b>1$, where $l_a$ is a distance from an ejection outlet side edge of the ejection energy generating means to the ejection outlet side edge of the bubble, and $l_b$ is a distance from that edge of the energy generating means remote from the ejection outlet to that edge of the bubble remote from the ejection outlet. It is a further preferable that the second and third conditions are simultaneously satisfied.

The description will be made as to the structure of the recording head used in the present invention.

Figure 3A:
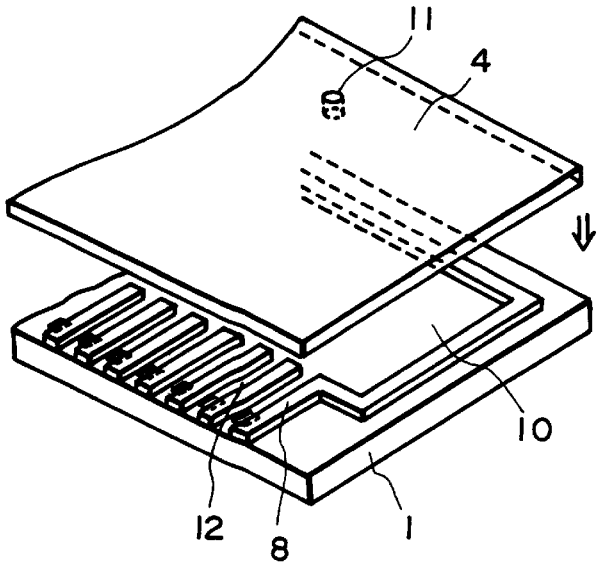
FIGS. 3A–B illustrates a recording head using the present invention.
Figure 3B:
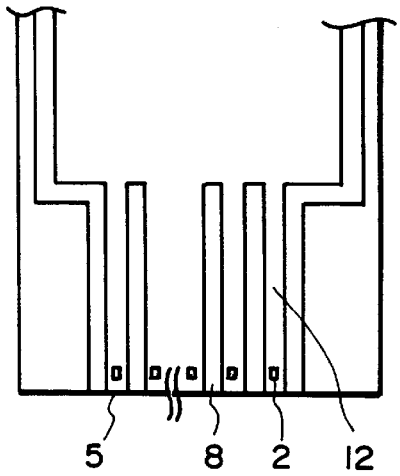

FIGS. 3A and 3B are a perspective view of a preferable recording head before the assembling thereof and a top plan view thereof. In FIG. 3B, the top plate shown in FIG. 3A is omitted.

The structure of the recording head shown in FIGS. 3A and 3B will be described. It comprises a base member 1 having walls 8, and a top plate 4 secured on the tops of the walls 8. By this joining, both the liquid passages 12 and the common liquid chamber 10 are formed. The top plate 4 is provided with a supply opening 11 for supplying the ink, and the ink is supplied into the liquid passage 12 through the common liquid chamber 10 to which the liquid passages 12 communicates.

The base member 1 is provided with heaters 2, and for each of the heaters 2, the liquid passages are formed. The heater 2 has a heat generating resistor layer (not shown) and an electrode (not shown) electrically connected with the heat generating resistor layer. The heater 2 is energized through the electrode in accordance with the recording signal. Upon energization, the heater 2 generates thermal energy to supply the thermal energy to the ink supplied into the liquid. The thermal energy produces a bubble in the ink in accordance with the recording signal.

Another structure of the recording head usable with the present invention will be described.

Figure 4A:
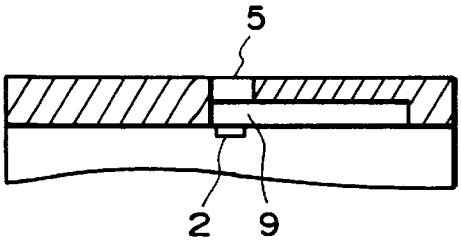
FIGS. 4A–B illustrates a recording head using the present invention.
Figure 4B:
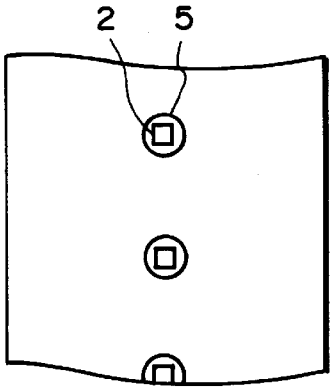

Referring to FIGS. 4A and 4B, there is shown a sectional view of the recording head and a top plan view. The difference of the recording head from the recording head shown in FIG. 4 is that the ink supplied into the liquid passage is ejected along or substantially along the liquid passage direction, whereas in FIGS. 4A and 4B, the ink is ejected at an angle from the ink passage (the ejection outlet is formed directly above the heater).

In FIGS. 4A and 4B, the same reference numerals as in FIGS. 3A and 3B are assigned to the elements having corresponding functions.

In FIGS. 4A and 4B, the ejection outlets 5 are formed in an orifice plate 16, and it integrally has walls 9 between the ejection outlets 5.

FIGS. 5(*a*), 5B, 5C, 5D, 5E are graphs of bubble internal pressure vs. volume change with time in a first specific liquid jet method and apparatus suitably usable with the present invention.

This is summarized as follows:

(1) A liquid jet method wherein a bubble is produced by heating ink to eject at least a part of the ink by the bubble, and wherein the bubble communicates with the ambience under or not under the condition that the internal pressure of the bubble is not higher than the ambient pressure.

(2) A recording apparatus including a recording head having an ejection outlet through which at least a part of ink is discharged by a bubble produced by heating the ink by an ejection energy generating means, a driving circuit for driving the ejection energy generating means so that the bubble communicates with the ambience under or not under the condition that the internal pressure of the bubble is not more than the ambient pressure, and a platen for supporting a recording material to face the ejection outlet.

According to the specific embodiment of the present invention, the volume and the speed of the discharged liquid droplets, so that the splash or mist which is attributable to the inability to perform of sufficiently high speed recording can be suppressed. The contamination of the background of images can be prevented. When the present invention is embodied as an apparatus, the contamination of the apparatus can be prevented. The ejection efficiency is improved. The clogging of the ejection outlet or the passage can be prevented. The service life of the recording head is expanded with high quality of the print.

Referring to FIGS. 6(*a–f*), the principles of liquid ejection will be described, before FIGS. 5A–5D are described. The liquid passage is constituted by a base 1, a top plate 4 and walls (not shown).

FIG. 6(*a*) shows the initial state in which the passage is filled with ink 3. The heater 2 (electro-thermal transducer, for example) is instantaneously supplied with electric current, the ink adjacent the heater 2 is abruptly heated by the pulse of the current, upon which a bubble 6 is produced on the heater 2 by the so-called film boiling, and the bubble abruptly expands (FIG. 6(*b*)). The bubble continues to expand toward the ejection outlet 5, that is, in the direction of low inertial resistance. It further expands beyond the outlet 5 so that it communicates with the ambience (FIG. 6(*c*)). At this time, the ambience is in equilibrium with the inside of the bubble 6, or it enters the bubble 6.

The ink 3 pushed out by the bubble through the outlet 5 moves forward further by the momentum given by the expansion of the bubble, until it becomes an independent droplet and is deposited on a recording material 101 such as paper (FIG. 6(*d*)). the cavity produced adjacent the outlet 5 is supplied with the ink from behind by the surface tension of the ink 3 and by the wetting wit the member defining the liquid passage, thus restoring the initial state (FIG. 6(*e*)). The recording medium 101 is fed to the position facing to the ink ejection outlet 5 on a platen by means of the platen, roller, belt or a suitable combination of them. As an alternative, the recording material 101 maybe fixed, while the outlet (the recording head) is moved, or both of them may be moved to impart relative movement therebetween. What is required is the relative movement therebetween to face the outlet to a desired position of the recording material.

In FIG. 6(*c*), in order that the gas does not move between the bubble 6 and the ambience, or the ambient gas or gasses enter the bubble, at the time when the bubble 6 communicates with the ambience, it is desirable that the bubble communicates with the ambience under the condition that the pressure of the bubble is equal to or lower then the ambient pressure.

Figure 5A:
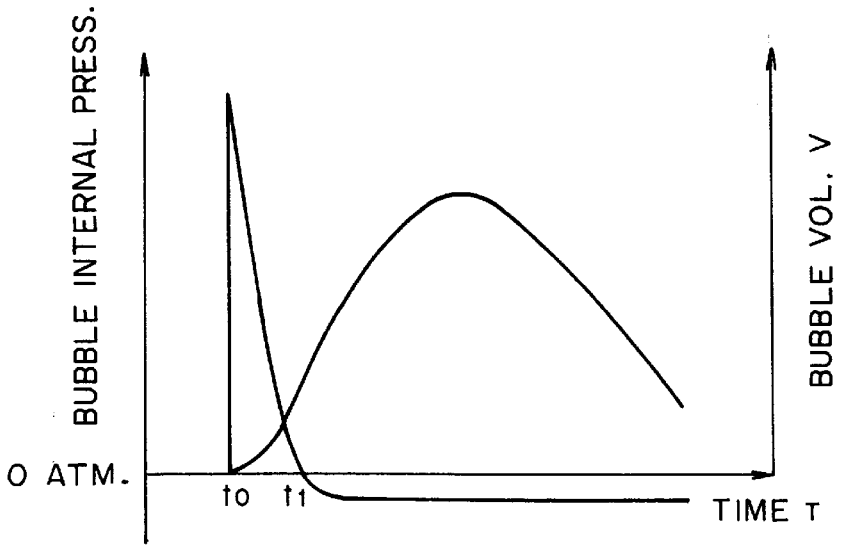
FIGS. 5A–E illustrates bubble internal pressure and the volume change in the present invention.
Figure 5B:
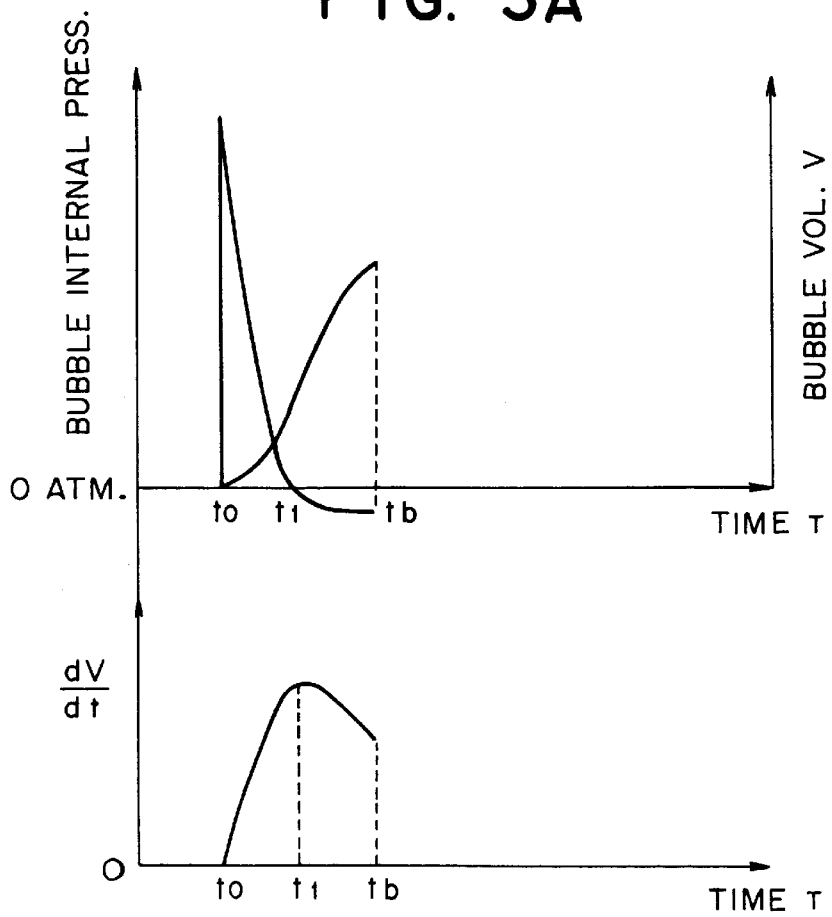

In order to satisfy the above, the bubble is made to communicate with the ambience in the period satisfy $t \geqq t1$ (t: time from bubble creation) as shown in FIG. 5A. Actually, however, the relation between the bubble internal pressure and the bubble volume with time is as shown in FIG. 5B, because the ink is ejected by the expansion of the bubble. Thus, the bubble is made to communicate with the ambience in the time satisfying $t=tb$ ($t1 \leqq tb$) in FIG. 5C (at t1, the internal pressure becomes equal to the extend pressure).

The ejection of the droplet under this condition is preferable to the ejection with the bubble internal pressure higher than the ambient pressure (the gas ejects into the ambience), in that the contamination of the recording paper or the inside of the apparatus due to the ink mist or splash. Additionally, the ink acquires sufficient energy, and therefore, a higher ejection speed, because the bubble communicates with the ambience only after the volume of the bubble increases.

In addition, it is further preferable to let the bubble communicate with the ambience under the condition that the bubble internal pressure is lower than the external pressure, since the above-described advantages are further enhanced.

The lower pressure communication is effective to prevent the unstabilized liquid adjacent the outlet from splashing which otherwise is liable to occur. In addition, it is advantageous in that the force, if not large, is applied to the unstabilized liquid in the backward direction, by which the liquid ejection is further stabilized, and unnecessary liquid splashing can be suppressed.

The recording head has the heater 2 adjacent to the outlet 5. This is the easy arrangement to make the bubble communicate with the ambience. However, the above-described preferable condition is not satisfied by simply making the heater 2 close to the outlet. The proper selections are made to satisfy it with respect to the amount of the thermal energy (the structure, material, driving conditions, area or the like of the heater, the thermal capacity of a member supporting the heater, or the like), the nature of the ink, the various sizes of the recording head (the distance between the ejection outlet and the heater, the widths and heights of the outlet and the liquid passage).

As a parameter for effectively embodying the communication ejection, there is a configuration of the liquid passage, as described hereinbefore. The width of the liquid passage is substantially determined by the configuration of the used thermal energy generating element. It has been found that the configuration of the liquid passage significantly influences the growth of the bubble, and that it is an effective factor.

In addition to the above-described condition, the communicating condition can be controlled by changing the height of the liquid passage. To be less susceptible to the ambient condition or the like and to be more stable, it is desirable that the height of the liquid passage is smaller than the width thereof ($H<W$).

It is also desirable that the communication between the bubble and the ambience occurs when the bubble volume is not less than 70%, further preferably, not less than 80% of the maximum volume of the bubble or the maximum volume which will be reached before the bubble communicates with the ambience.

The description will be made as to the method of measuring the relation between the bubble internal pressure and the ambient pressure.

It is difficult to directly measure the pressure in the bubble and therefore, the pressure relation between them is determined in one or more of the following manners.

First, the description will be made as to the method of determining the relation between the internal pressure and the ambient pressure on the basis of the measurements of the change, with time, of the bubble volume and the volume of the ink outside the outlet.

Figure 5C:
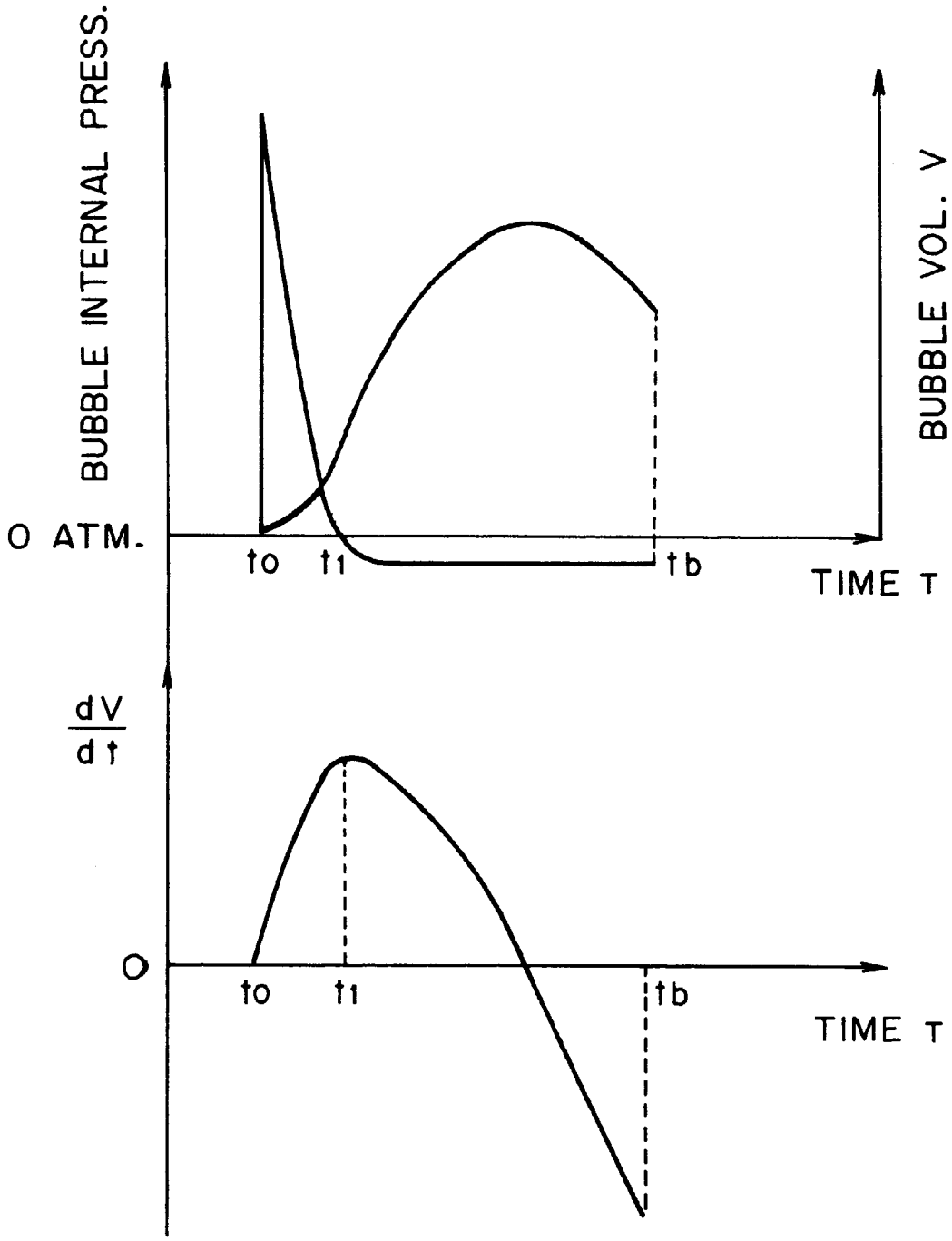
Figure 5D:
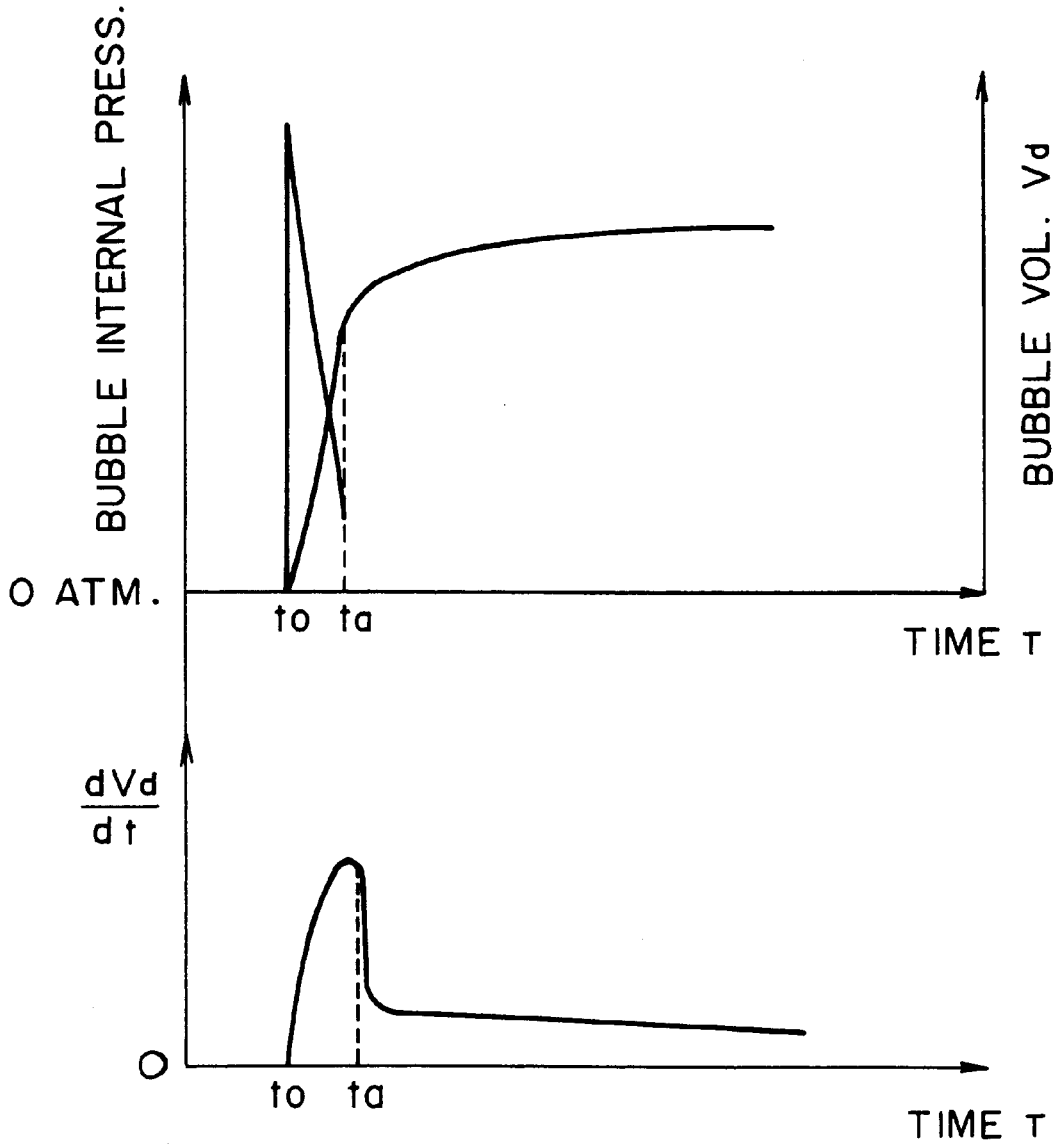
Figure 5E:
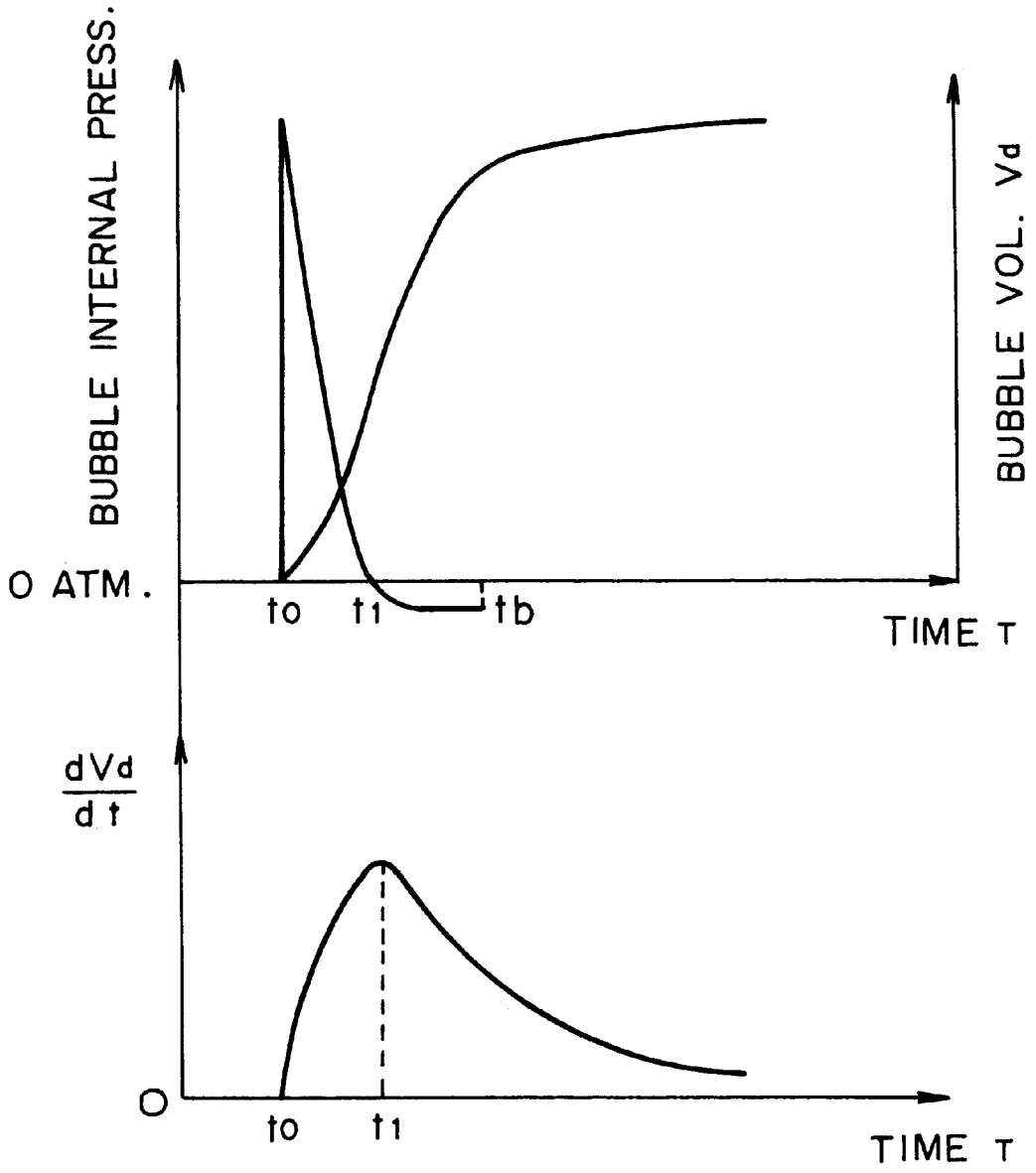
Figure 6A:
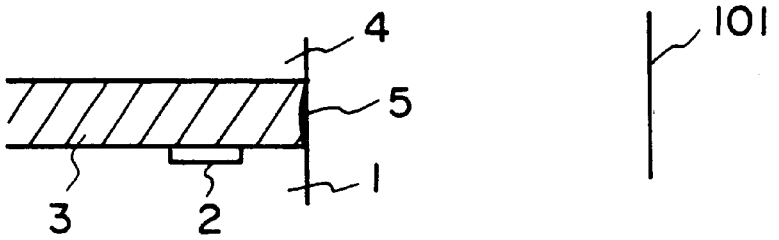
FIGS. 6(A–F) illustrates ejection of the liquid.
Figure 6B:
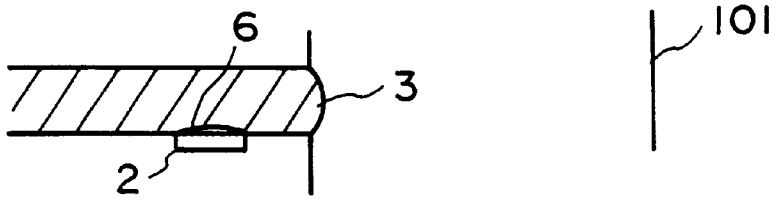
Figure 6C:
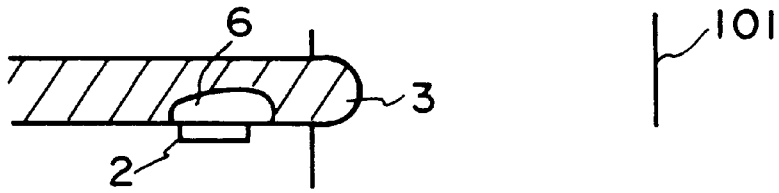
Figure 6D:
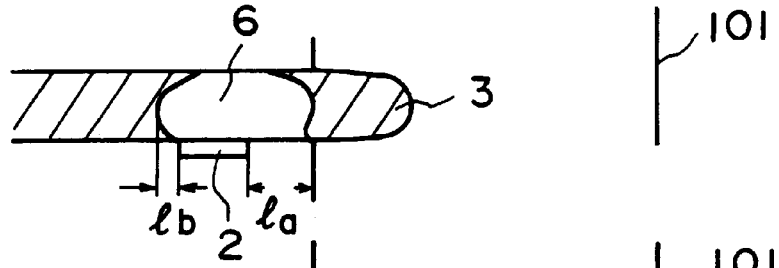
Figure 6E:
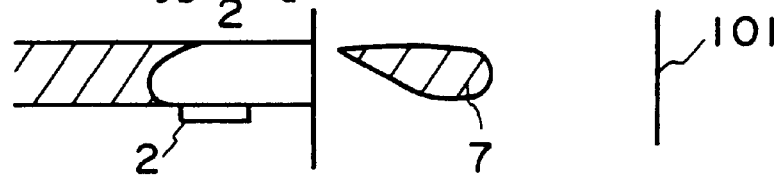
Figure 6F:
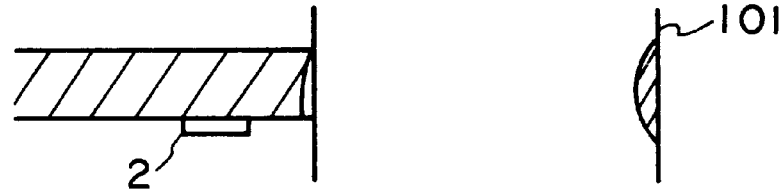

The volume V of the bubble is measured from the start of the bubble creation to the communication thereof with the ambience. Then the second order differential $d^2V/dt^2$ is calculated, by which the relation (which is larger) between the internal pressure and the ambient pressure is known, because if $d^2V/dt^2>0$, the internal pressure of the bubble is higher than the external pressure, and if $d^2V/dt^2 \leqq 0$, the internal pressure is equal to or less than the external pressure. Referring to FIG. 5C, from the time $t=t_0$ to the time $t=t_1$, the internal pressure is higher than the external pressure, and $d^2V/dt^2>0$; from the time $t=t_1$ to the time $t=t_b$ (occurrence of communication), the internal pressure is equal to or less than the ambient pressure, and $d^2V/dt^2 \leqq$. Thus, by determining the second order differential of the volume V, ($d^2V/dt^2$), the higher one of the internal and external pressure is determined.

Here, it is required that the bubble can be observed directly or indirectly from the outside. In order to permit observance of the bubble externally, a part of the recording head is made of transparent material. Then, the creation, development or the like of the bubble is observed from the outside. If the recording head is, made of non-transparent material, a top plate or the like of the recording head may be replaced with a transparent plate. For the better replacement from the standpoint of equivalency, the hardness, elasticity and the like are as close as possible with each other.

If the top plate of the recording head is made of metal, non-transparent ceramic material or colored ceramic material, it may be replaced with transparent plastic resin material (transparent acrylic resin material) plate, glass plate or the like. The parts of recording head to be replaced and the material to replace them are not limited to the described above.

In order to avoid differences in the nature of the bubble formation or the like due to the difference in the nature of the materials, the material used to replace preferably has the wetting nature relative to the ink or another nature which is as close as possible to that of the material. Whether the bubble creation is the same or not may be confirmed by comparing the ejection speeds, the volumes of ejected liquid or the like before and after the replacement. If a suitable part of the recording head is made of transparent material, the replacement is not required.

Even if any suitable part cannot be replaced with another material, it is possible to determine which of the internal pressure and the external pressure is larger, without the replacement. This method will be described.

In another method, in the period from the start of the bubble creation to the ejection of the ink, the volume Vd of the ink is measured, and the second order differential $d^2Vd/dt^2$ is obtained. Then, the relation between the internal pressure and the external pressure can be determined. More specifically, if $d^2Vd/dt^2>0$, the internal pressure of the bubble is higher than the external pressure, and if $d^2Vd/dt^2 \leqq 0$, the internal pressure is equal to or less than the external pressure. FIG. 5C shows the change, with time, of the first order differential dVd/dt of the volume of the ejected ink when the bubble communication occurs with the internal pressure higher than the external pressure. From the start of the bubble creation ($t=t_0$) to the communication of the bubble with the ambience (t=ta), the internal pressure of the bubble is higher than the external pressure, and $d^2Vd/dt^2>0$. FIG. 5(*e*) shows the change, with time, of the first order differential dVd/dt of the volume ejected when the bubble communication occurs with the internal pressure being equal to or lower than the external pressure. From the start of the bubble creation ($t=t_0$) to the communication of the bubble with the ambience ($t=t_1$), the internal pressure of the bubble is higher than the external pressure, and $d^2Vd/dt^2=0$. However, in the period from t=tp to $tp=t_b$, the bubble internal pressure is equal to or lower than the external pressure, and $d^2Vd/dt^2 \leqq 0$.

Thus, on the basis of the second order differential $d^2Vd/dt^2$, it can be determined which is higher, the internal pressure or the external pressure.

The description will be made as to the measurement of the volume Vd of the ink outside the ejection outlet. The configuration of the droplet at any time after the ejection can be determined on the basis of observation, by a microscope, of the ejecting droplet while it is illuminated with a light source such as stroboscope, LED or laser. The pulse light is emitted to the recording head driven at regular intervals, with synchronization therewith and with a predetermined delay. By doing so, the configuration of the bubble as seen in one direction at the time which is the predetermined period after the ejection, is determined. The pulse width of the pulse light is preferably as small as possible, provided that the quantity of the light is sufficient for observation, since then the configuration determination is accurate.

With this method, if the gas flow is observed in the external direction from the liquid passage at the instance when the bubble communicates with the ambience, it is understood that the communication occurs when the internal pressure of the bubble is higher than the ambient pressure. If the gas flow into the liquid passage is observed, it is understood that the communication occurs when the bubble internal pressure is lower than the ambient pressure.

As for other preferable conditions, the bubble communicates with the ambience when the first order differentiation of the movement speed of an ejection outlet side end of the bubble is negative, as shown in FIG. 7; and the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet. It is further preferable that both of the above conditions are satisfied when the bubble communicates with the ambience.

Referring to FIGS. 6(*a–f*), there is shown the growth of the bubble in a liquid jet method and apparatus of a second example suitable to the present invention.

this is summarized as follows:

(3) A recording method using a recording head including an ejection outlet for ejecting ink, a liquid passage communicating with the ejection outlet and an ejection energy generating means for generating thermal energy contributable to ejection of the ink by creation of a bubble in the liquid passage, wherein the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet.

(4) A recording apparatus including a recording head having an ejection outlet for ejecting ink, a liquid passage communicating with the ejection outlet and ejection energy generating means for generating thermal energy contributable to ejection of the ink by creation of a bubble in the liquid passage, a signal supply circuit for supplying a signal to the ejection energy generating means so that the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet, a platen for supporting a recording material for reception of the liquid ejected.

FIG. 6(*a*) shows the initial state in which the passage is filled with ink 3. The heater 2 (electro-thermal transducer, for example) is instantaneously supplied with electric current, the ink adjacent the heater 2 is abruptly heated by the pulse of the current in the form of the driving signal from the driving circuit upon which a bubble 6 is produced on the heater 2 by the so-called film boiling, and the bubble abruptly expands (FIG. 6(*b*)). The bubble continues to expand toward the ejection outlet 5 (FIG. 6(*c*)), that is, in the direction of low inertial resistance. It further expands beyond the outlet 5 so that it communicates with the ambience (FIG. 6(*d*)). Here, the bubble 6 communicates with the ambience when $1_a/1_b \geqq 1$ is satisfied, where $1_a$ is a distance from an ejection outlet side of the heater 2 functioning as the ejection energy generating means and an ejection outlet side end of the bubble 6, and $1_b$ is a distance from that end of the heater 2 remote from the ejection outlet and that end of the bubble 6 which is remote from the ejection outlet.

The ink 3 pushed out by the bubble through the outlet 5 moves forward further by the momentum given by the expansion of the bubble, until it becomes an independent droplet and is deposited on a recording material 101 such as paper (FIG. 6(*e*)). The cavity produced adjacent the outlet 5 is supplied with ink from behind by the surface tension of the ink 3 and by the wetting with the member defining the liquid passage, thus restoring the initial state (FIG. 6(*f*)). The recording medium 101 is fed to the position facing the ink ejection outlet 5 on a platen by means of the platen, roller, belt or a suitable combination of them. As an alternative, the recording material 101 may be fixed, while the outlet (the recording head) is moved, or both of them may be moved to impart relative movement therebetween. What is required in the relative movement therebetween to face the outlet to a desired position of the recording material.

If the liquid is ejected in accordance with the principle described above, the volume of the liquid ejected through the ejection outlet is constant at all times, since the bubble communicates with the ambience. When it is used for the recording, a high quality image can be produced without non-uniformity of the image density.

Since the bubble communicates with the ambience under the condition of $1_a 1_b \geqq 1$, the kinetic energy of the bubble can be efficiently transmitted to the ink, so that the ejection efficiency is improved.

Furthermore, when the liquid is ejected under the above-described conditions, the time required for the cavity produced adjacent to the ejection outlet after the liquid is ejected to be filled with new ink can be reduced as compared with the liquid (ink) is ejected under the condition of $1_a/1_b < 1$, and therefore, the recording speed is further improved.

The description will be made as to the method of measuring the distances $1_a$ and $1_b$ when the bubble communicates with the ambience in the second condition. For example, in the case of the recording head shown in FIGS. 6(*a–f*), the top plate 4 is made of transparent glass plate. The recording head is illuminated from the above by a light source capable of pulsewise light emission such as stroboscope, laser or LED. The recording head is observed through microscope.

More particularly, the pulsewise light source is turned on and off in synchronism with the driving pulses applied to the heater, and the behavior from the creation of the bubble to the ejection of the liquid is observed, using the microscope and camera. Then, the distances $1_a$ and $1_b$ are determined.

The width of the liquid passage is substantially determined by the configuration of the used thermal energy generating element, but it is determined on the basis of rule of thumb. However, it has been found that the configuration of the liquid passage is significantly influential to growth of the bubble, and that it is an effective factor for the above condition of the thermal energy generating element in the passage in the second specific embodiment.

Using the height of the liquid passage, the growth of the bubble may be controlled so as to satisfy $1_a/1_b \geqq 1$, preferably $1_1/1_b \geqq 2$, and further preferably $1_a/1_b \geqq 4$. It has been found that the liquid passage height H is smaller than at least the liquid passage width W (H<W), since then the recording operation is less influenced by the ambient condition or another, and therefore, the operation is stabilized. This is because the communication between the bubble and the ambience occurs by the bubble having an increased growing speed in the interface at the ceiling of the liquid passage, so that the influence of the internal wall to the liquid ejection can be reduced, thus further stabilizing the ejection direction and speed. In the second specific embodiment, it has been found that $H \leqq 0.8W$ is preferable since then the ejection performance does not change, and therefore, the ejection is stabilized even if the high speed ejection is effected for a long period of time.

Furthermore, by satisfying $H \leqq 0.65W$, a highly accurate deposition performance can be provided even if the recording ejection is quite largely changed by carrying different recording information.

It is further preferable in addition to the above conditions that the first order differential of the moving speed of the ejection outlet side end of the bubble is negative, when the bubble communicates with the ambience.

Referring to FIG. 7, there is shown the change, with time, of the internal pressure and the volume of the bubble in a liquid jet method and apparatus according to a third example suitable to the present invention. The third specific embodiment is summarized as follows:

(5) A liquid jet method using a recording head having an ejection outlet for ejecting ink, a liquid passage communicating with the ejection outlet and an ejection energy generating element for generating thermal energy contributing to the ejection of the ink by creation of a bubble in the liquid passage, wherein a first order differential of a movement speed of an ejection outlet side end of the created bubble is negative, when the bubble created by the ejection energy generating means communicates with the ambience through the ejection outlet.

(6) A liquid jet apparatus comprising a recording head having an ejection outlet for ejection ink, a liquid passage communicating with the ejection outlet and an ejection energy generating element for generating thermal energy contributing to the ejection of the ink by creation of a bubble in the liquid passage, a signal supply circuit for supplying a signal to the ejection energy generating means so that a first order differential of a movement speed of an ejection outlet side end of the created bubble is negative, when the bubble created by the ejection energy generating means communicates with the ambience through the ejection outlet, and a platen for supporting a recording material for reception of the liquid ejected.

The third example provides a solution to the problem solved by the first example, by a different method. The major problem underlying this third example is that the ink existing adjacent the communicating portion between the bubble and the ambience is over-accelerated with the result of the ink existing there is separated from the major part of the ink droplet. If this separation occurs, the ink adjacent thereto is splashed, or is scattered into mist.

In addition, where the ejection outlets are arranged with high density, improper ejection will occur by the deposition of such ink. The third specific embodiment is based on the finding that the drawbacks are attributable to the acceleration.

More particularly, it has been found that the problems arise when the first order differential of the moving speed of the ejection outlet side end of the bubble is positive when the bubble communicates with the ambience.

FIGS. 7(*a*) and 7(*b*) are graphs of the first order differential and the second order differential (the first order differential of the moving speed) of the displacement of the ejection outlet side end of the bubble from the ejection outlet side end of the heater until the bubble communicates with the ambience. It will be understood that the above discussed problems arise in the case of a curve A in FIGS. 7(*a*) and (*b*), where the first order differential of the moving speed of the ejection outlet side end of the bubble is positive.

Figure 7A:
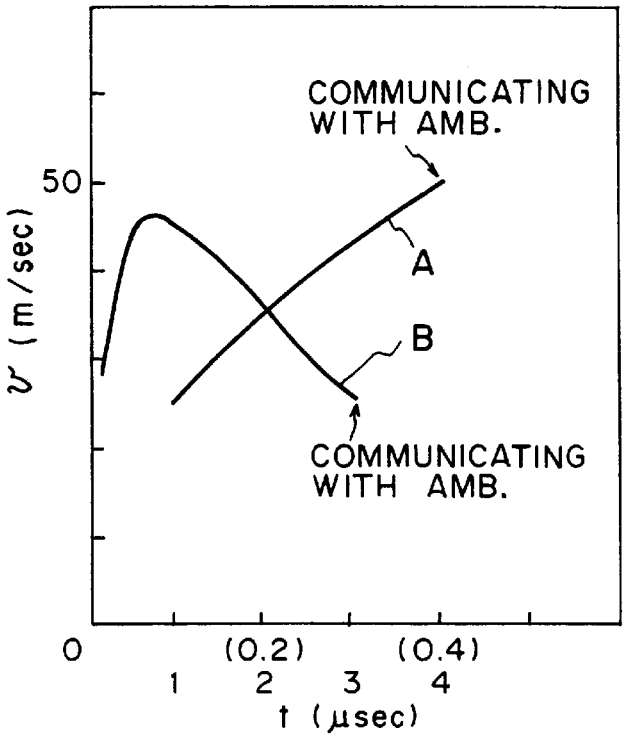
FIGS. 7A and 7B illustrate a liquid ejection method used in the present invention.
Figure 7B:
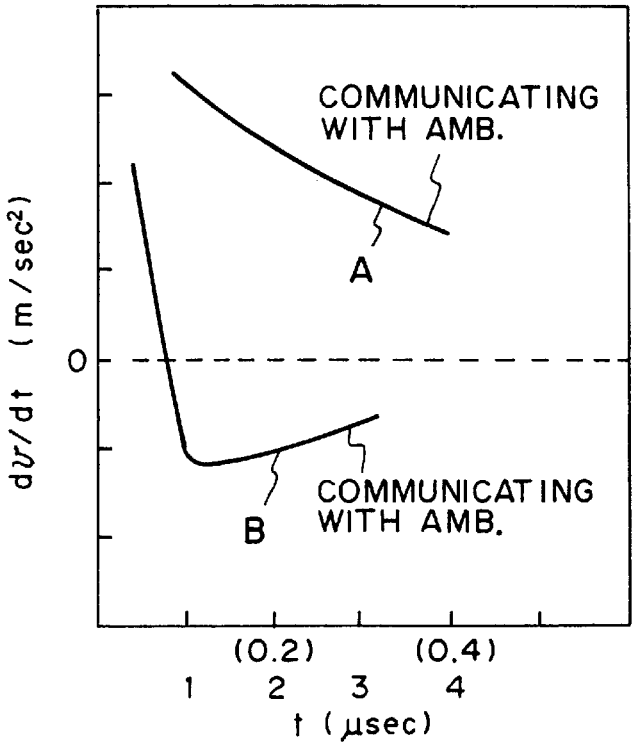
Figure 8:
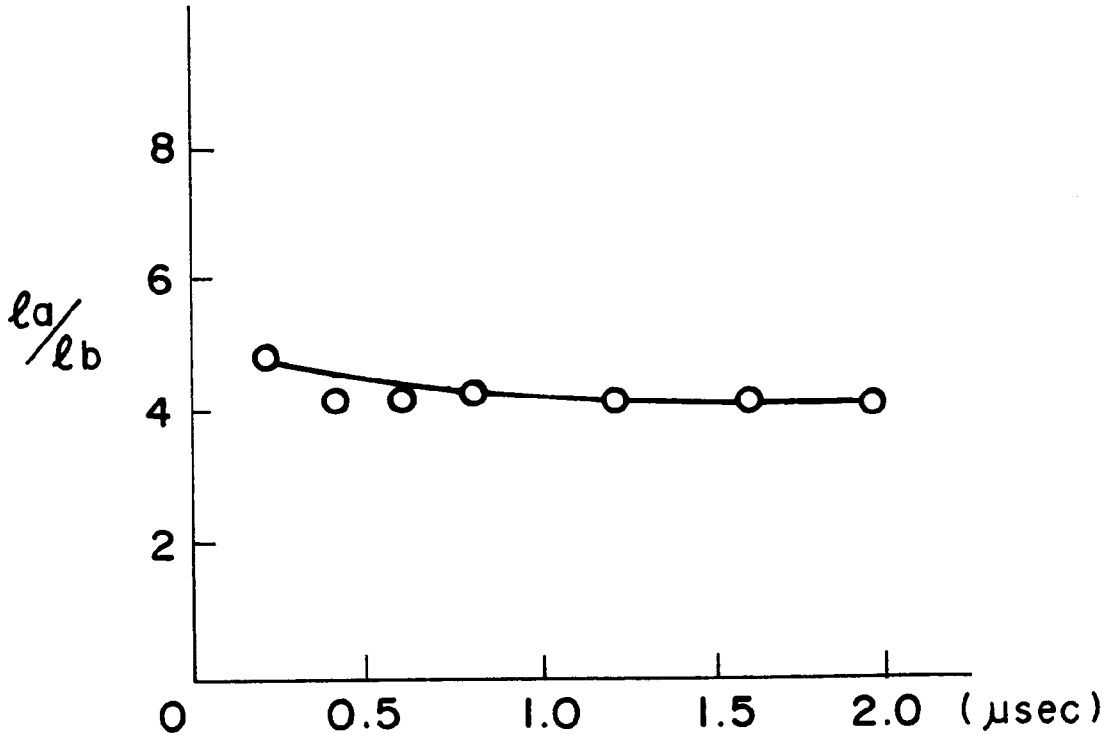
FIG. 8 is a graph showing the change of a front to end ratio la/lb of a bubble.
Figure 9A:
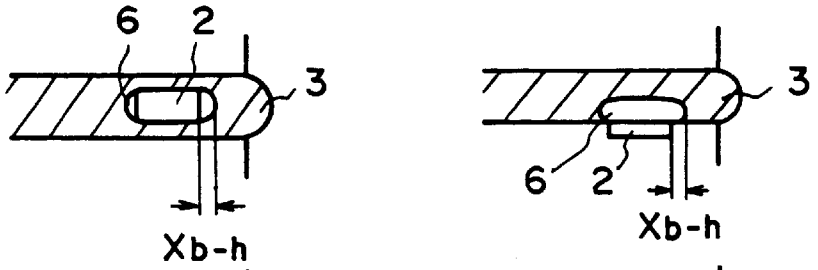
FIGS. 9A–I show the change of the front end of the bubble per unit time.
Figure 9B:
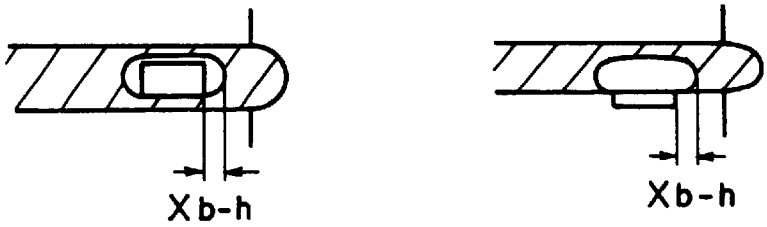
Figure 9C:
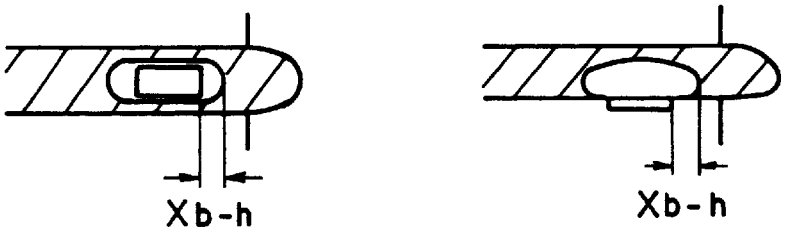
Figure 9D:
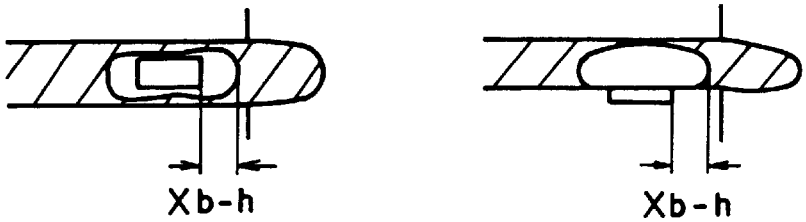
Figure 9E:
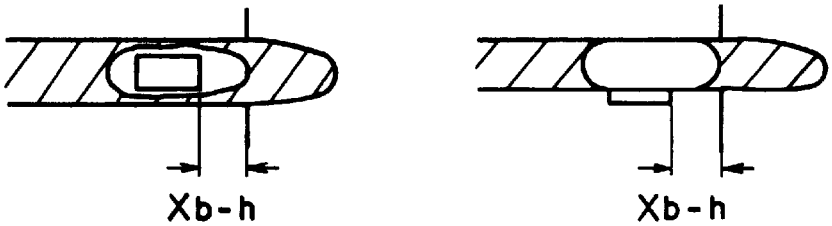
Figure 9F:
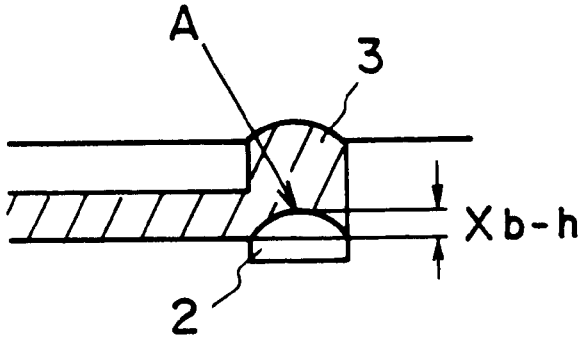
Figure 9G:
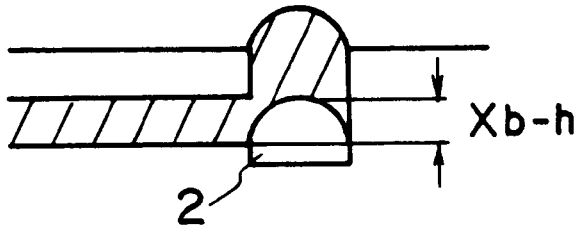
Figure 9H:
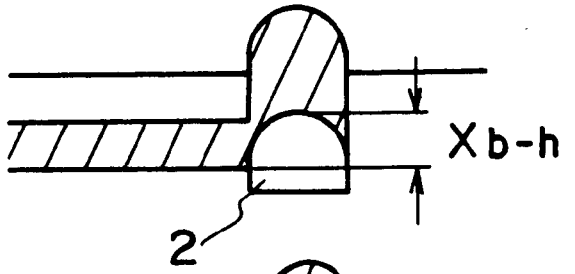
Figure 9I:
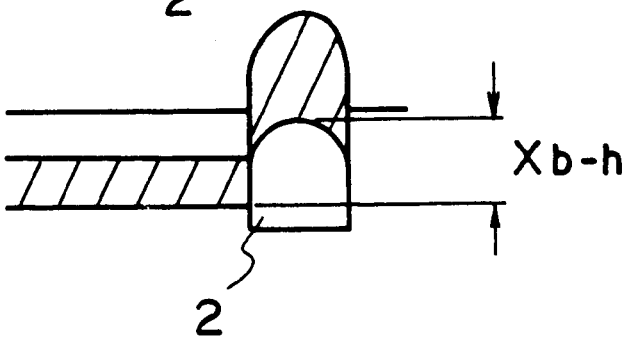

Curves B in FIGS. 7A and 7B represent the third example or condition using the concept of FIGS. 6(*a–f*). The created bubble communicates with the ambience under the condition that the first order differential of the moving speed of the ejection outlet side end of the bubble. By doing so, the volumes of the liquid droplets are stabilized, so that high quality images can be recorded without ink mist or splash and the resulting paper and apparatus contamination.

Additionally, since the kinetic energy of the bubble can be sufficiently transmitted to the ink, the ejection efficiency is improved so that the clogging of the nozzle can be avoided. The droplet ejection speed is increased, so that the ejection direction can be stabilized, and the required clearance between the recording head and the recording paper can be increased so that the designing of the apparatus is made easier.

The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, expansion and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response.

The present invention is effectively applicable to a so-called full-line type recording head having a length corresponding to the maximum recording width. Such a recording head may comprise a single recording head an plural recording head combined to cover the maximum width.

In addition, the present invention is applicable to a series type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The description will be made as to the method of determining the moving speed of the ejection outlet side end of the bubble and the first order differential of the moving speed.

The position of the ejection outlet side end of the bubble at the respective times after the start of the bubble creation can be observed by a microscope wherein the bubble is illuminated from the top or side with pulse light such as stroboscope (LED) or laser. More particularly, as shown in FIGS. 9A–I, wherein the ejection process is shown, the change, with time, of the displacement $x_{b\text{-}h}$ of the ejection outlet side end of the bubble from the ejection side end of the heater from the start of the bubble creation to the communication of the bubble with the ambience. On the basis of the measurements, a first order differential $dx_{b\text{-}h}/dt$ of the displacement is obtained, by which the moving speed vx of the ejection outlet side end of the bubble is obtained. Then, the first order differential dvx/dt of the moving speed (the second order differential $d^2x_{b\text{-}h}/d^2t$ of the displacement) can be obtained.

Here, it is required that the bubble can be observed directly, or indirectly from the outside. In order to permit observance of the bubble externally, a part of the recording head is made of transparent material. Then, the creation, development or the like of the bubble is observed from the outside. If the recording head is of non-transparent material, a top plate or the like of the recording head may be replaced with a transparent plate. For the better replacement from the standpoint of equivalency, the hardness, elasticity and the like are preferably as close as possible with each other.

If the plate of the recording head is made of metal, non-transparent ceramic material or colored ceramic material, it may be replaced with transparent plastic resin material (transparent acrylic resin material) plate, glass plate or the like. The part of recording head to be replaced and the material to replace are not limited to those described above.

In order to avoid difference in the nature of the bubble formation or the like due to differences in the nature of the materials, the material used as a replacement preferably has the wetting nature relative to the ink or another nature which is as close as possible to that of the material. Whether the bubble creation is the same or not may be confirmed by comparing the ejection speeds, the volumes of the ejected liquid or the like before and after the replacement. If a suitable part of the recording head is made of transparent material, replacement is not required.

As described in the foregoing, according to the present invention, the created bubble can be brought into communication with the ambience with stability and high efficiency when the ink droplet is ejected. Therefore, the volume of the liquid droplet can be stabilized to provide a high quality image without image disturbance. In addition, the kinetic energy of the bubble can be sufficiently transmitted to the ink, and therefore, the ejection efficiency is improved, and clogging can be prevented. Furthermore, since the ejection speed of the droplet is increased, and therefore, the ejecting direction of the droplet is stabilized, and the distance between the recording head and the recording sheet can be increased so that the design of the apparatus is made easier.

Additionally, the bubble extinction step is not used, and therefore, the damage to the heat generating resistor can be avoided, and therefore, the service life of the recording head is improved.

While the invention has been described with reference to the structures disclosed herein, it is not confined to the details set forth and this application is intended to cover such modifications or changes as may come within the purposes of the improvements or the scope of the following claims.

What is claimed is:

1. A liquid jet recording method comprising the steps of:

providing a recording liquid which is normally liquid;

providing a liquid jet recording head having a liquid passage and a liquid outlet, said liquid passage having a heat generating resistor, wherein the following conditions are satisfied:

$S1 \geqq S2/3$, and $S2 \geqq S3/3$ where S1 is an area of the heat generating resistor, S2 is a projected area, onto a surface having the heat generating resistor, of said liquid passage between said liquid outlet and said heat generating resistor, and S3 is a cross-sectional area of said liquid outlet;

applying thermal energy to the recording liquid in the liquid passage and thereby causing film boiling of the liquid to produce a bubble for ejecting the liquid through the liquid outlet, while said liquid jet recording head is not heated, except by said heat generating resistor;

permitting the bubble to communicate with an atmosphere adjacent the liquid outlet, wherein the bubble does not block said liquid passage when the bubble communication with the atmosphere occurs; and refilling the liquid passage after the ejecting of the liquid.

2. A method according to claim 1, wherein the bubble communicates with the ambience when an internal pressure of the bubble is not more than external pressure.

3. A liquid jet recording method according to claim 1, wherein the bubble communication with the atmosphere occurs when an internal pressure of the bubble is not more than a pressure of the atmosphere.

4. A recording apparatus comprising:

a liquid jet recording head having a liquid passage and a liquid outlet;

said liquid passage being provided with a heat generating resistor, wherein the following conditions are satisfied:

$S1 \geqq S2/3$, and $S2 \geqq S3/3$ wherein S1 is an area of the heat generating resistor, S2 is a projected area, onto a surface having the heat generating resistor, of said liquid passage between said liquid outlet and said heat generating resistor, and S3 is a cross-sectional area of said liquid outlet;

wherein said heat generating resistor applies thermal energy to a recording liquid in the liquid passage to cause film boiling of the liquid to produce a bubble for ejecting the liquid through the liquid outlet, while said liquid jet recording head is not heated, except by said heat generating resistor, wherein the recording liquid is normally liquid;

a driving circuit for driving said heat generating resistor to permit the bubble to communicate with an atmosphere adjacent the liquid outlet, wherein the bubble does not block said liquid passage when the bubble communication with the atmosphere occurs.

5. An apparatus according to claim 4, wherein the bubble communicates with the ambience when an internal pressure of the bubble is not more than external pressure.

6. A recording apparatus as in claim 4, wherein the bubble communication with the atmosphere occurs when an internal pressure of the bubble is not more than a pressure of the atmosphere.

7. A liquid jet recording head, comprising:

a liquid outlet; and a liquid passage, said liquid passage being provided with a heat generating resistor, wherein the following conditions are satisfied:

$S1 \geqq S2/3$, and $S2 \geqq S3/3$ wherein S1 is an area of the heat generating resistor, S2 is a projected area, onto a surface having the heat generating resistor, of said liquid passage between said liquid outlet and said heat generating resistor, and S3 is a cross-sectional area of said liquid outlet;

wherein said heat generating resistor applies thermal energy to a recording liquid in the liquid passage to cause film boiling of the liquid to produce a bubble for ejecting the liquid through the liquid outlet, while said liquid jet recording head is not heated, except by said heat generating resistor, wherein the recording liquid is normally liquid;

wherein said heat generating resistor is driven to permit the bubble to communicate with an atmosphere adjacent to the liquid outlet, and wherein the bubble does not block said liquid passage when the bubble communication with the atmosphere occurs.

8. A liquid jet recording head as in claim 7, wherein the bubble communication with the atmosphere occurs when an internal pressure of the bubble is not more than a pressure of the atmosphere.

* * * * *

UNITED STATES PATENT AND TRADEMARK OFFICE

CERTIFICATE OF CORRECTION

PATENT NO. : 6,203,142 B1
DATED : March 20, 2001
INVENTOR(S) : Toshiharu Inui et al.

It is certified that error appears in the above-identified patent and that said Letters Patent is hereby corrected as shown below:

Title page,
Item [56], References Cited, under FOREIGN PATENT DOCUMENTS,
"54161935" should read -- 54-161935 --;
"55100169" should read -- 55-100169 --; and
"61197246" should read -- 61-197246 --.

Column 3,
Line 65, "illustrates" should read -- illustrate --.

Column 4,
Lines 1 and 3, "illustrates" should read -- illustrate --; and
Line 5, "FIG. 6(A-F) illustrates" should read -- FIGS. 6A-F illustrate --.

Column 6,
Line 63, "shows" should read -- show --.

Column 8,
Line 2, "the" should be deleted;
Line 14, "a" should be deleted;
Line 30, "passages" should read -- passage --; and
Line 59, "FIG. 5(a)," should read -- FIG. 5A, --.

Column 9,
Line 46, "wit" should read -- with --; and
Line 48, "to" (second occurrence) should be deleted.

Column 11,
Line 22, "is," should read -- is --; and
Line 35, "difference" should read -- differences --.

Column 12,
Line 46, "this" should read -- This --.

Column 13,
Line 17, "circuit" should read -- circuit, --.

UNITED STATES PATENT AND TRADEMARK OFFICE

CERTIFICATE OF CORRECTION

PATENT NO. : 6,203,142 B1
DATED : March 20, 2001
INVENTOR(S) : Toshiharu Inui et al.

It is certified that error appears in the above-identified patent and that said Letters Patent is hereby corrected as shown below:

Column 15,
Line 65, "development" should read -- expansion --.

Column 16,
Line 7, "series" should read -- serial --.

Column 17,
Line 3, "was" should read -- were --.

Column 18,
Line 22, "liquid;" should read -- liquid; and --.

Signed and Sealed this

Eighteenth Day of June, 2002

*Attest:*

*Attesting Officer*

JAMES E. ROGAN
*Director of the United States Patent and Trademark Office*